US005675986A

United States Patent [19]

Chen

[11] Patent Number: 5,675,986

[45] Date of Patent: Oct. 14, 1997

[54] AIR-CONDITIONING FAN

[76] Inventor: Tze-Li Chen, P.O Box 82-144, Taipei, Taiwan

[21] Appl. No.: 547,228

[22] Filed: Oct. 24, 1995

[51] Int. Cl.[6] ..... F25D 17/06

[52] U.S. Cl. ..... 62/426; 62/515; 62/331

[58] Field of Search ..... 62/89, 267, 331, 62/404, 426, 531, 515

[56] References Cited

U.S. PATENT DOCUMENTS

| | | | |
|---|---|---|---|
| 1,831,825 | 11/1931 | Schutz | 62/426 |
| 1,865,924 | 7/1932 | Kritzer | 62/426 |
| 2,121,177 | 6/1938 | Shipley | 62/426 |
| 2,454,654 | 11/1948 | Kaufman | 62/426 |
| 2,498,342 | 2/1950 | Petticrew | 62/426 |
| 2,648,202 | 8/1953 | Otterholm | 62/426 |
| 3,799,255 | 3/1974 | Luderssen | 165/122 |
| 4,615,176 | 10/1986 | Tippmann | 62/62 |
| 5,524,450 | 6/1996 | Chen | 62/259.1 |

FOREIGN PATENT DOCUMENTS

| | | | |
|---|---|---|---|
| 2040465 | 2/1990 | Japan | 62/404 |
| 6147553 | 5/1994 | Japan | 62/404 |

*Primary Examiner*—William Doerrler
*Attorney, Agent, or Firm*—Alfred Lei

[57] ABSTRACT

An air-conditioning fan including a stand, a compressor mounted within the stand, a motor arranged on an upper end of the stand, an impeller fixedly mounted on an output axle of the motor, an evaporator sleeved over the motor, and a condensing case provided with a condenser, an exhaust fan mounted in front of the condenser, and a plurality of air inlets, the condenser being connected with the compressor and the evaporator.

1 Claim, 3 Drawing Sheets

AIR-CONDITIONING FAN

BACKGROUND OF THE INVENTION

1. Field of the Invention

This invention relates to an air-conditioning fan which can regulate humidity and temperature in buildings.

2. Description of the Prior Art

The conventional electric fan includes a base, a motor mounted on the base, and an impeller fixedly connected with an output shaft of the motor. As the impeller is rotated by the motor, a current of air will be set up for ventilating or cooling. However, such an electric fan suffers from the following drawbacks:

1. When used in a badly ventilated room, the electric fan will not be able to lower the temperature thereby rendering it useless.

2. As the electric fan has been running for a long period time, the motor will become hot thus increasing the temperature of the air current and therefore making the electric fan useless.

SUMMARY OF THE INVENTION

This invention relates to an air-conditioning fan.

It is the primary object of the present invention to provide an air-conditioning fan which can be used for regulating humidity and temperature in buildings.

It is another object of the present invention to provide an air-conditioning fan which is low in noise.

It is still another object of the present invention to provide an air-conditioning fan which is easy to assemble.

It is still another object of the present invention to provide an air-conditioning fan which is low in cost.

It is a further object of the present invention to provide an air-conditioning fan which is convenient in use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
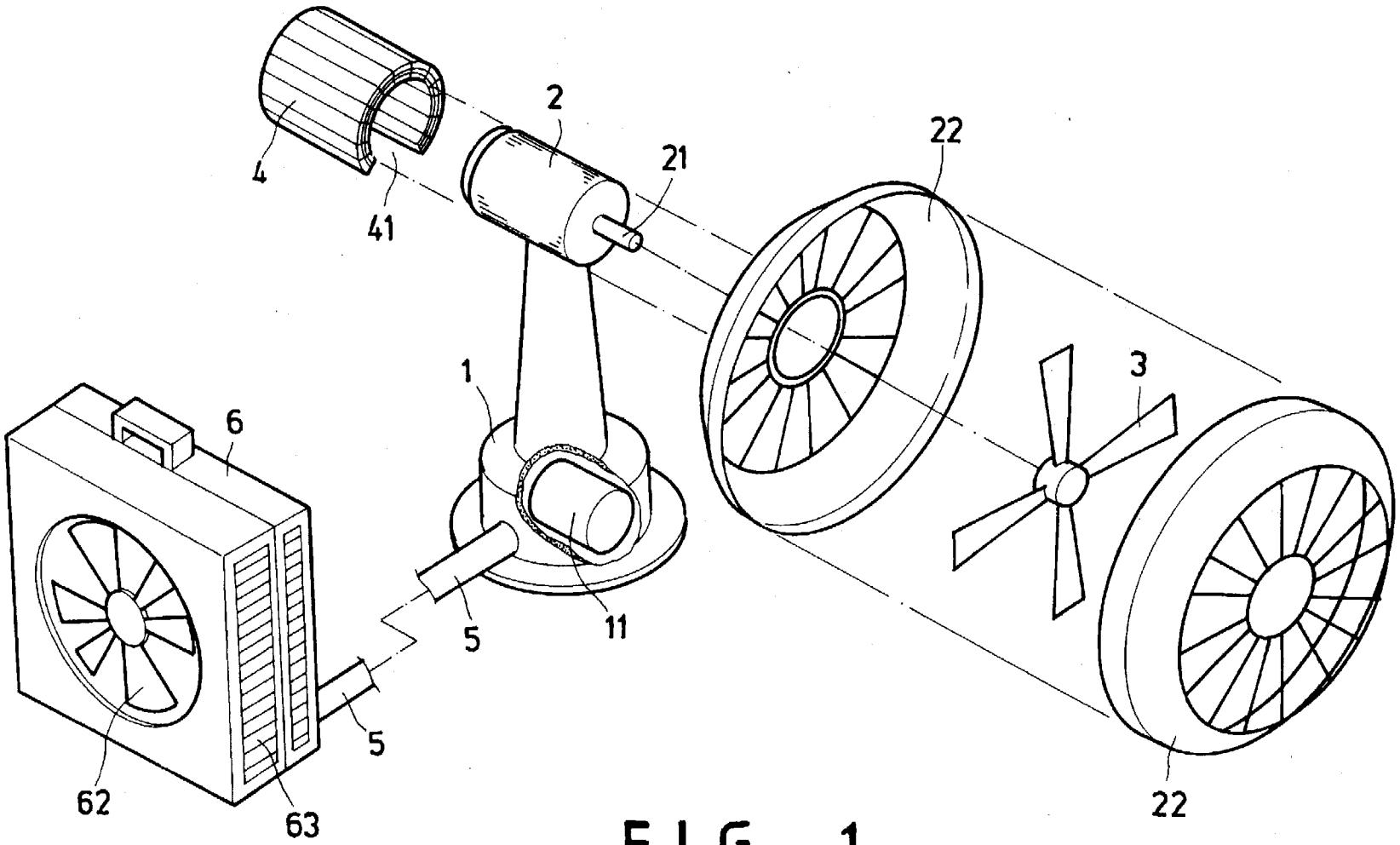
FIG. 1 is an exploded view of the present invention.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
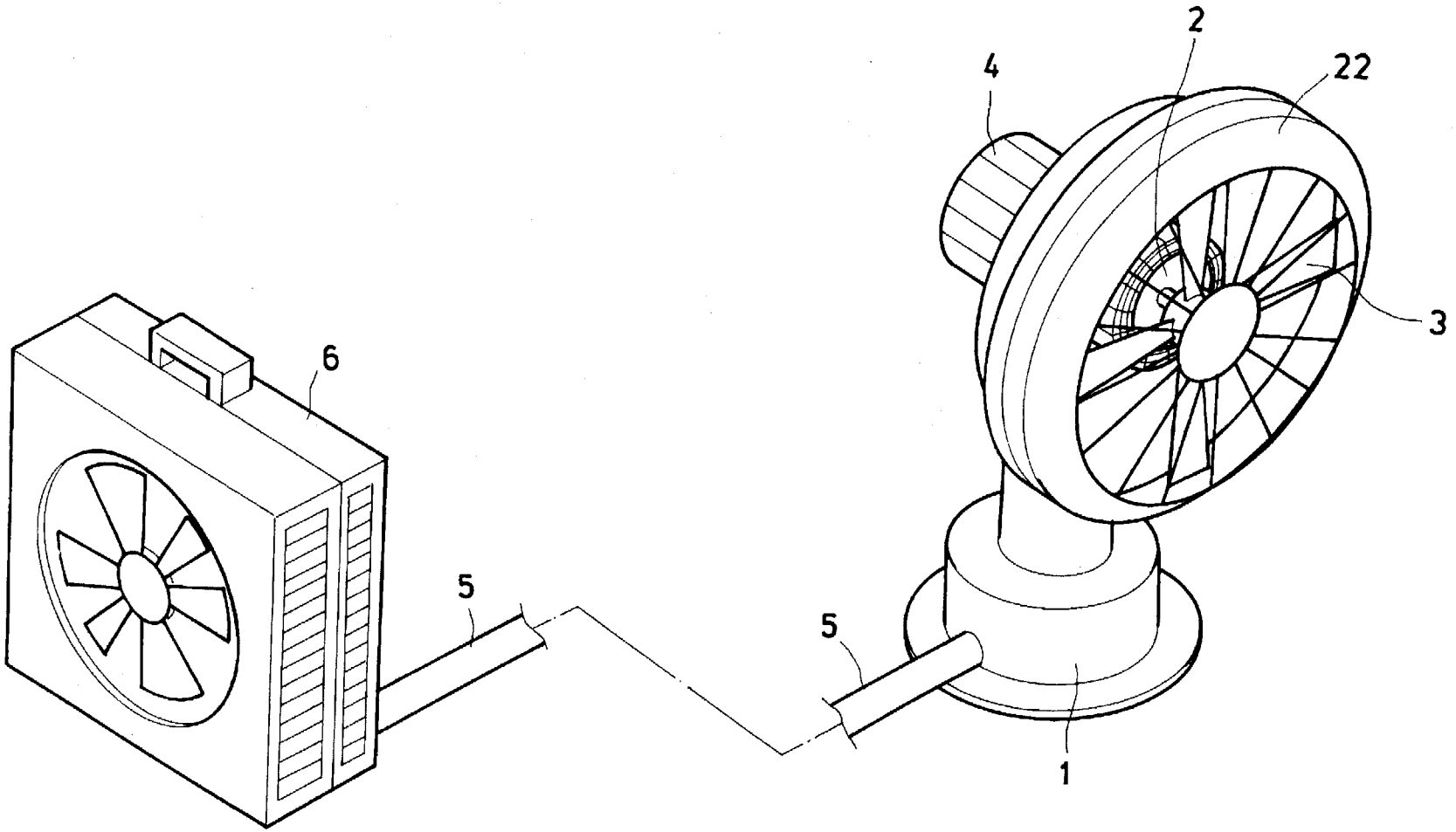
FIG. 2 is a perspective view of the present invention.

With reference to the drawings and in particular to FIGS. 1 and 2 thereof, the air-conditioning fan according to the present invention mainly comprises a stand 1, a motor 2, an impeller 3, an evaporator 4, a pipe 5, and a condensing case 6. A compressor 11 is mounted within the stand 1. The motor 2 is arranged on the upper end of the stand 1 and provided with an output axle 21. The impeller 3 is fixedly mounted on the output axle 21 of the motor 2. The evaporator 4 is formed with a U-shaped notch 41 at its bottom. The stand 5 is connected with the condensing case 6 through the pipe 5. The condensing case 6 is provided with a condenser 61, an exhaust fan 62, and a plurality of air inlets 63.

As shown in FIG. 2, the evaporator 4 is sleeved over the motor 2, with its U-shaped notch 41 receiving the upper end of the stand 1. The impeller 3 is fixedly mounted on the output axle 21 of the motor 2 and provided with a protective cover 22. Within the pipe 5 there are a plurality of refrigerant pipes. An electric exhaust fan 62 is mounted within the condensing case 6 and disposed in front of the condenser 61.

Figure 3:
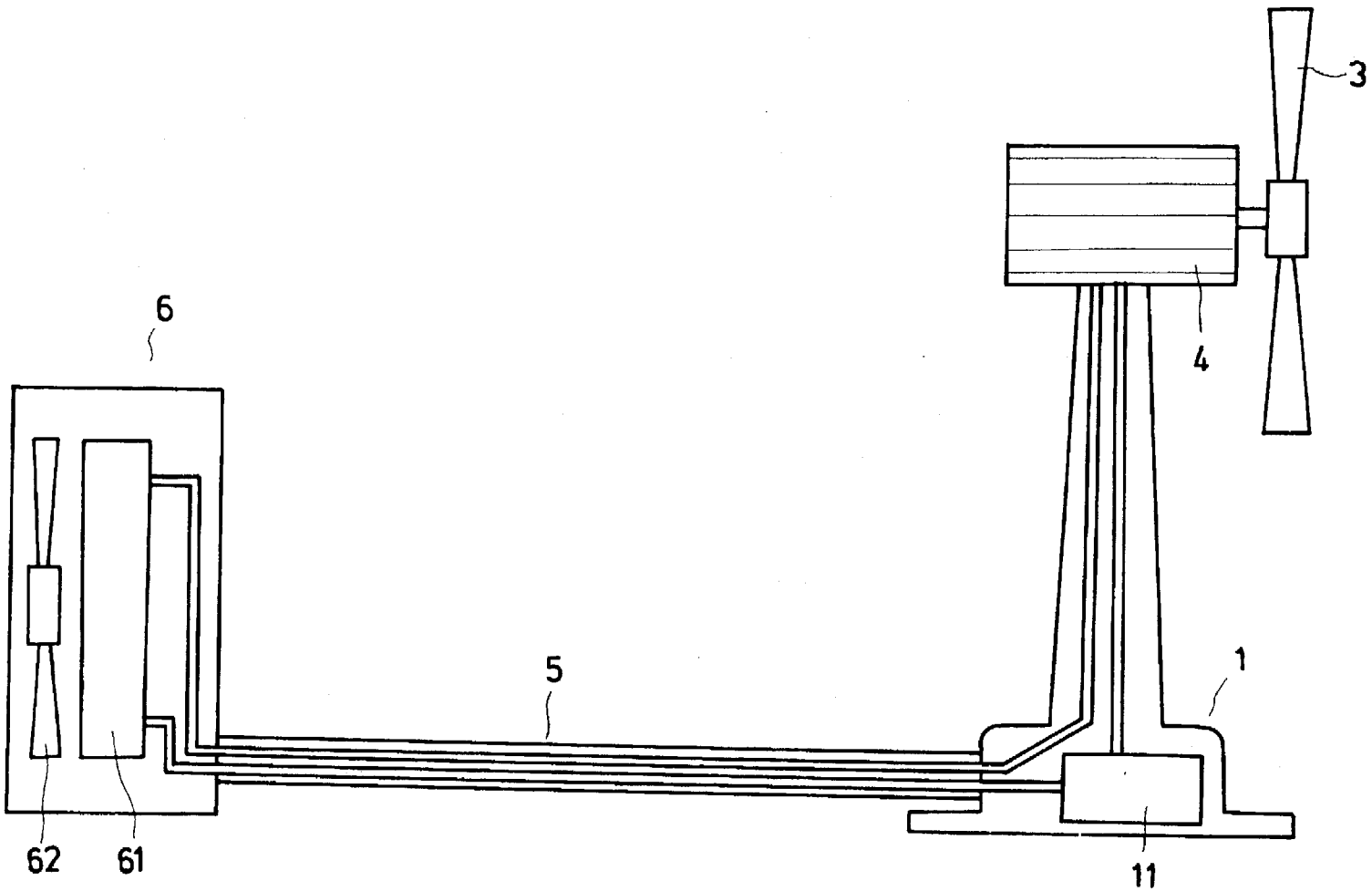
FIG. 3 is a sectional view of the present invention.

Referring to FIG. 3, the compressor 11, the evaporator 4 and the condensor 61 are connected with refrigerant pipes enclosed within the pipe 5. The compressor 11 circulates a refrigerant from the evaporator 4 through the condenser 61 in the condensing case 6 and expansion valve (not shown) and back to the evaporator 4. The evaporator 4 is placed over the impeller 3 that extracts hot and humid air from the room. It takes heat from the air, making its moisture condense into water droplets which are collected in a water tray (not shown). The cool dry air then returns to the room. The exhaust fan 62 removes the heat from the condenser 61 outside the room.

However, it should be noted that the circulation of the refrigerant may be reversed to make the fan to send out warm air. This technique is well known in the art and will not be described here in detail.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An air-conditioning fan comprising:

a stand;

a compressor mounted within said stand;

a motor arranged on an upper end of said stand;

an evaporator sleeved over said motor;

an impeller fixedly mounted on an output axle of said motor and arranged in front of said evaporator; and a condensing case provided with a condenser, an exhaust fan mounted in front of said condenser, and a plurality of air inlets, said condenser being connected with said compressor and said evaporator.

* * * * *